US005253560A

United States Patent [19]

McDonald et al.

[11] Patent Number: 5,253,560

[45] Date of Patent: Oct. 19, 1993

[54] SHEET DISPENSER

[76] Inventors: Gordon G. McDonald, 5 Melford Avenue, Westermains, Kirkintilloch, Scotland; Michael W. Barnes, 451 Houghfold Way, Harwood Bolton, Bl2 3PU, Lancashire, England

[21] Appl. No.: 912,228

[22] Filed: Jul. 10, 1992

Related U.S. Application Data

[63] Continuation of Ser. No. 464,816, Jan. 16, 1990, abandoned.

[30] Foreign Application Priority Data

Jan. 19, 1989 [GB] United Kingdom ..... 89011845

[51] Int. Cl.[5] ..... B26D 7/10

[52] U.S. Cl. ..... 83/171; 83/175; 83/649

[58] Field of Search ..... 83/171, 175, 649, 651.1, 83/431, 446, 16, 18

[56] References Cited

U.S. PATENT DOCUMENTS

| | | | |
|---|---|---|---|
| 2,726,706 | 12/1955 | Hakomaki | 83/171 X |
| 3,131,278 | 4/1964 | Rosenthal | 83/171 X |
| 3,134,005 | 5/1964 | Mayhew | 83/171 |
| 3,169,430 | 2/1965 | Mallie et al. | 83/171 X |
| 3,595,456 | 7/1971 | Rosenthal | 83/171 X |
| 3,730,411 | 5/1973 | Brockmuller | 83/175 X |
| 3,797,345 | 3/1974 | Allen | 83/175 |
| 3,901,112 | 8/1975 | Koswinckel | 83/171 |
| 3,919,905 | 11/1975 | Hoffman | 83/649 X |
| 3,924,497 | 12/1975 | D'Angelo et al. | 83/16 |
| 3,977,055 | 8/1976 | Gilpatrick | 83/431 X |
| 4,488,466 | 12/1984 | Jones | 83/175 |

FOREIGN PATENT DOCUMENTS

| | | | |
|---|---|---|---|
| 2127054 | 10/1972 | France | 83/175 |

*Primary Examiner*—Eugenia Jones

*Attorney, Agent, or Firm*—Dressler, Goldsmith, Shore, Sutker & Milnamow, Ltd.

[57] ABSTRACT

A sheet dispenser for dispensing thin film such as collagen film for wrapping food. The dispenser consists of a cabinet in which a row of collagen film is supported on rollers and the film is pulled off the roll by driven rollers. When a predetermined length has been pulled off the roll it is severed by a hot wire system in which the hot wire is located between rollers and supported in a tension head controlled by spring. A cutter bar supported on pivoted arms moves across so as to press the film against the hot wire during the cutting action.

3 Claims, 5 Drawing Sheets

SHEET DISPENSER

This application is a continuation, of application Ser. No. 07/464,816, filed Jan. 16,1990 and now abandoned.

This invention relates to a sheet dispenser for dispensing predetermined lengths of sheet material. The dispenser may be used for many different materials such as thin film known as cling film, collagen film for wrapping food, or any other film-like sheet which needs to be dispensed in predetermined lengths and to be cut from a roll.

An object of the invention is to provide a compact and efficient film dispenser which will accurately dispense predetermined lengths of films and will cut them accurately and neatly.

In accordance with the present invention the sheet material dispenser, particularly for collagen sheet, comprises motor driven means to extract a predetermined length of sheet material from a roll of material located in the cabinet, and means to sever the dispensed sheet from the roll.

Preferably the means to sever the dispensed sheet from the roll comprises an electrically heated wire.

The wire may be supported transversely of the cabinet and there may be two tension rollers, carried by a tension head one above and one below the wire and means to press the sheet against the rollers during severing. The means to press the sheet against the roller may comprise a transverse bar with means to move the bar towards the wire so that the bar contacts the tension rollers and move the tension head against spring pressure so that the sheet contacts and is cut by the stationary hot wire.

Alternatively the dispensed sheet may simply be gripped and tension applied to it by rollers or tension blocks and then the wire moved through the sheet so as to cut it. The roll of material may simply be supported on either rollers and be driven by motor driven rollers which are in contact with the sheet and pull it off the roller.

If a cutter bar is used it is preferably supported on pivoted levers which are operable by solenoids.

The whole operation may be made automatic so that after a predetermined length of sheet has been dispensed the cutting operation is automatically effected and the hot wire, if used, is automatically held in contact with the sheet for a predetermined time such as to sever the sheet without danger of burning or melting it.

Figure 6A:
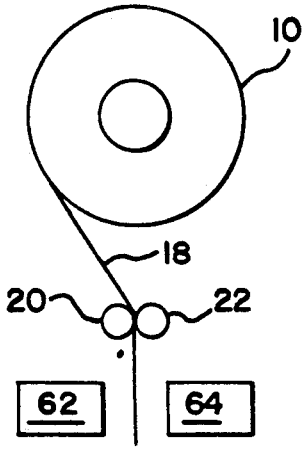
Figure 6B:
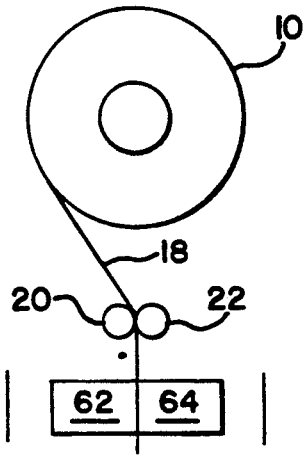
Figure 6C:
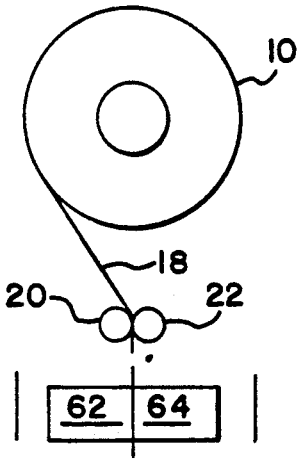
Figure 6D:
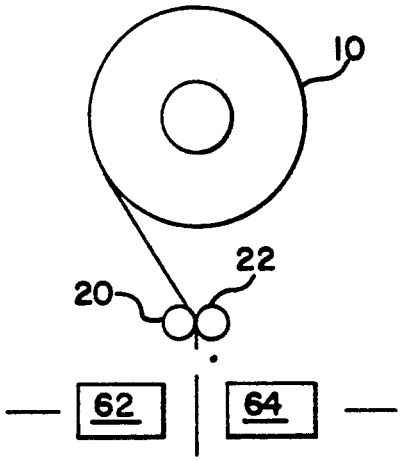
Figure 7A:
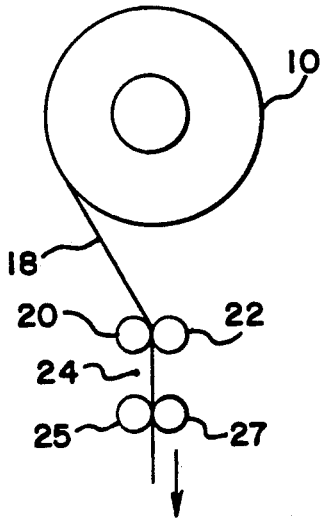
Figure 7B:
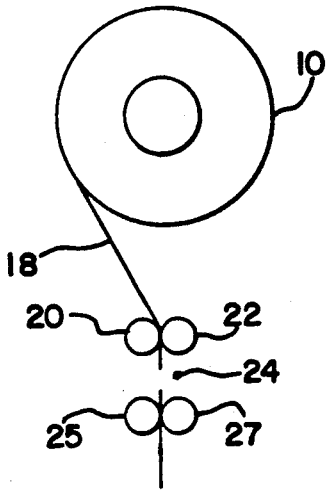

FIGS. 4*a, b, c* and *d* show one form of cutting head, and illustrate the stages in the use of the cutting head to sever a dispensed length of collagen film;

FIG. 5*a, b, c* and *d* are similar illustrations of use of a different type of cutting head known as a beak cutting head;

FIGS. 6*a, b, c* and *d* show the use of another form of cutter known as a feed roll tension bar cutter and show the different stages in operation of this cutter; and FIGS. 7*a* and *b* illustrate yet another form of cutter known as twin feed roll tension head and illustrate stages in the use of this form of the invention.

The sheet dispenser which is about to be described is particularly adapted for dispensing predetermined lengths of collagen film from a roll. As seen particularly in FIGS. 1, 2 and 3 the dispenser is contained in a cabinet 8 in which is placed a collagen film roll 10 supported by a roll carrier 12 which has idler rolls 14 and 16 contacting the base roll 11 which carries the collagen film. The collagen film roll simply rests on the idler rolls and is not driven by them.

Figure 2:
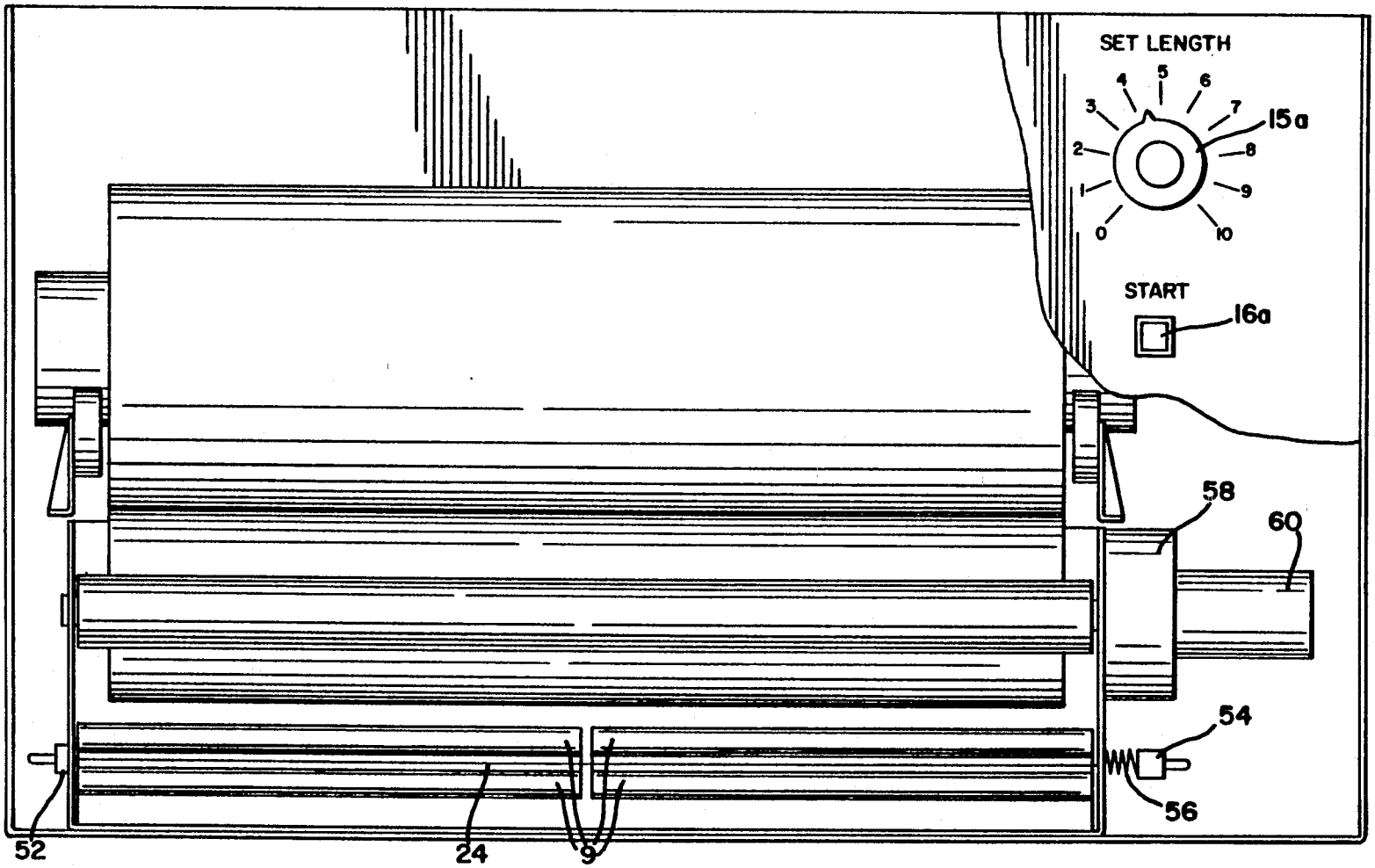
FIG. 2 is a front elevation of the dispenser with the cover and a cutter bar assembly removed to enable other parts to be seen.

The collagen film 18 is extracted from the film roll by feed rolls 20 and 22, roll 20 being driven (as seen in FIG. 2) by a motor 60 driving through a gear box 58.

After passing a hot wire cutter 24 the film is dispensed through the aperture 23 in the lower part of the casing 8.

The hot wire cutter is supported as shown in FIG. 2 between electrical connections 52 and 54 and is held in tension by spring 56.

Figure 1:
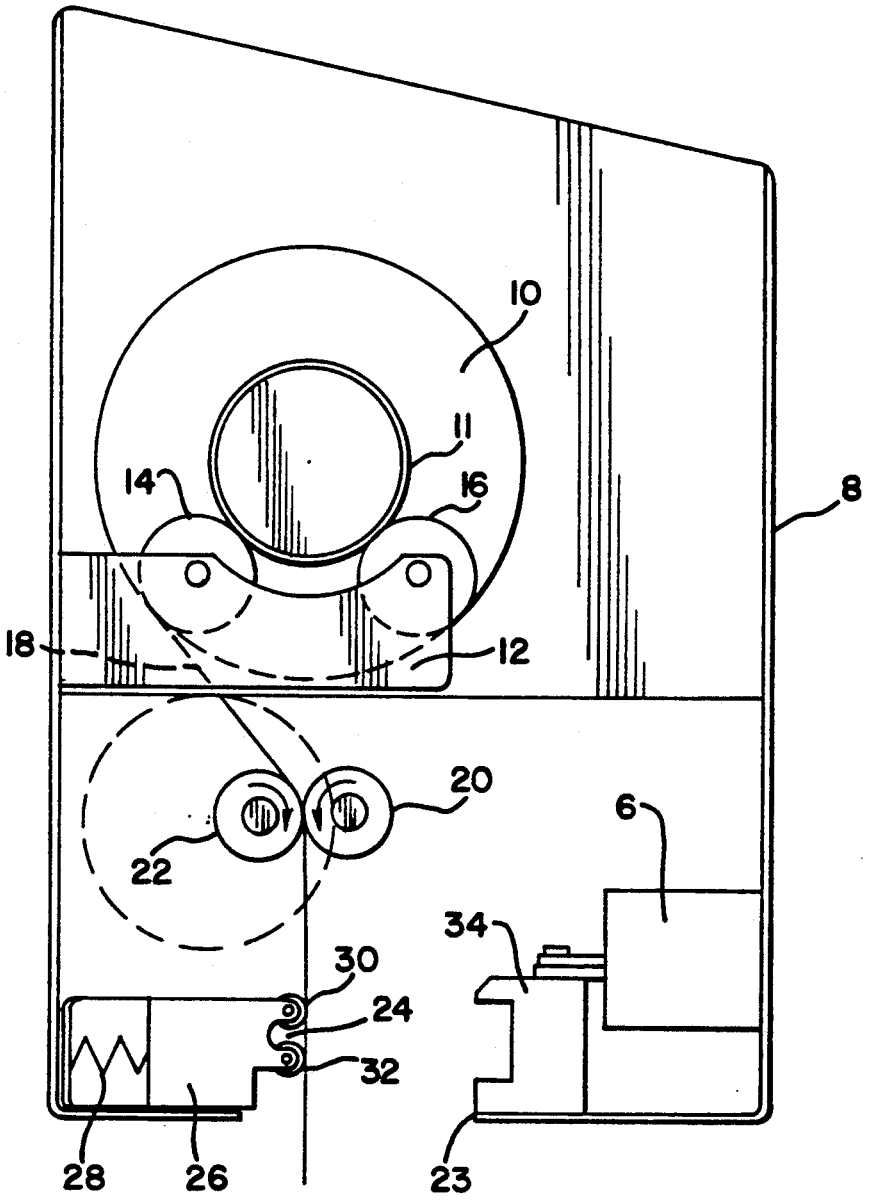
FIG. 1 is a side elevation of a sheet dispenser in the form of a collagen film dispenser, the side panel of the dispenser being removed to show the internal workings.

Above and below the hot wire cutter in the arrangement shown in FIG. 1, there are tension head rollers 30 and 32 supported in a tension head 26 which is biased towards the right as seen in FIG. 1 by spring 28.

Figure 3:
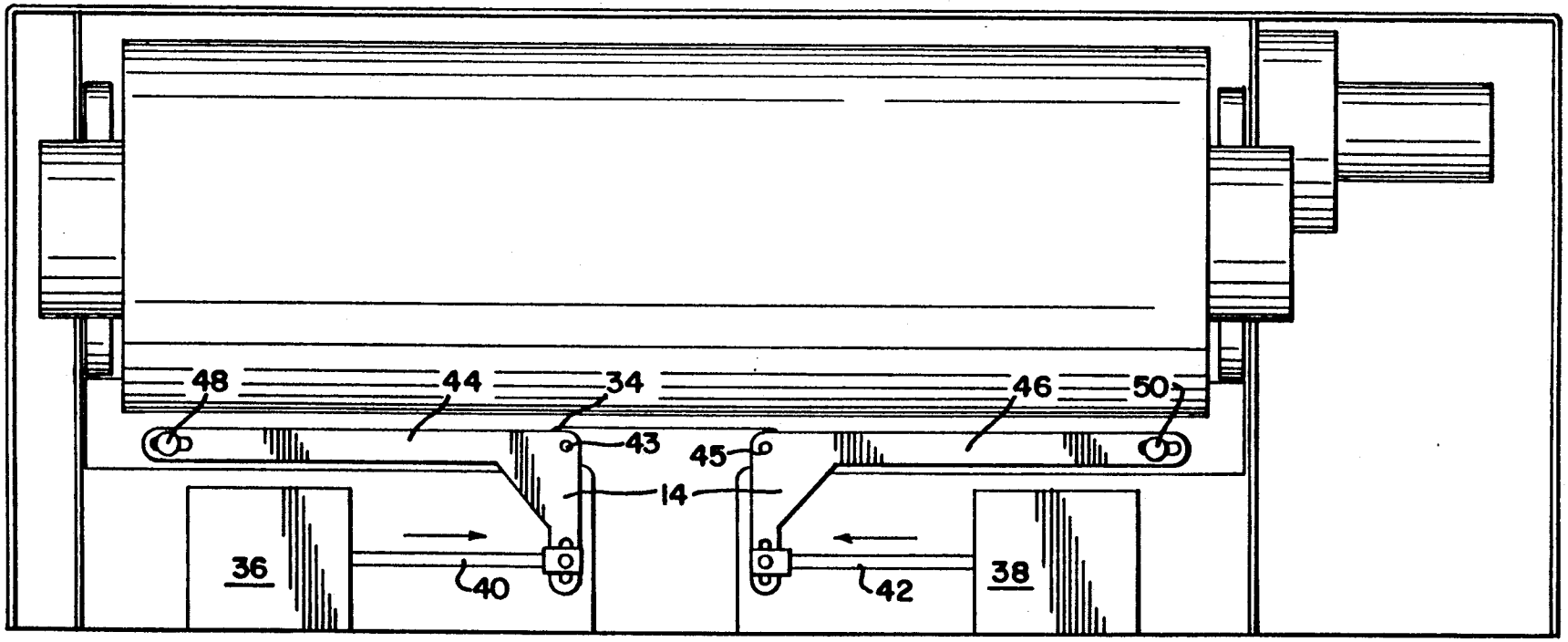
FIG. 3 is a plan of the machine with the cover removed.

A cutter bar 34 is carried, as shown in FIG. 3, by two levers 44 and 46 pivoted respectively of 43 and 45 and linked to the cutter bar 34 by pins 48 and 50.

The levers 44 and 46 are movable by means of respective arms 40 and 42 operated by solenoids 36 and 38. By operating both solenoids simultaneously the cutter bar may be moved from right to left as seen in FIG. 1 so as to contact rollers 30 and 32 and to push the tension head to the left against pressure of spring 28. Thus bringing the collagen film 18 into contact with the hot wire 24 so that a predetermined length is severed.

In use of the machine as shown in FIGS. 1, 2 and 3 the operator sets up a predetermined length of collagen film which is to be dispensed and switches the machine on. The setting he has selected results in the motor 60 operating for a predetermined time so as to pass a predetermined length of film out of the casing 8. When the predetermined amount has been dispensed the solenoids 36 and 38 automatically operate so as to move the levers 44 and 46 to bring the cutter bar 34 into contact with the tension head rollers 30 and 32 thus forcing the tension head back against the pressure spring 28 and bringing the collagen film into contact with the hot wire cutter. This causes the film to be severed and the predetermined cut length of collagen film falls out of the bottom of the casing 8 and may be collected in a suitable tray or other receptacle.

Figure 4:
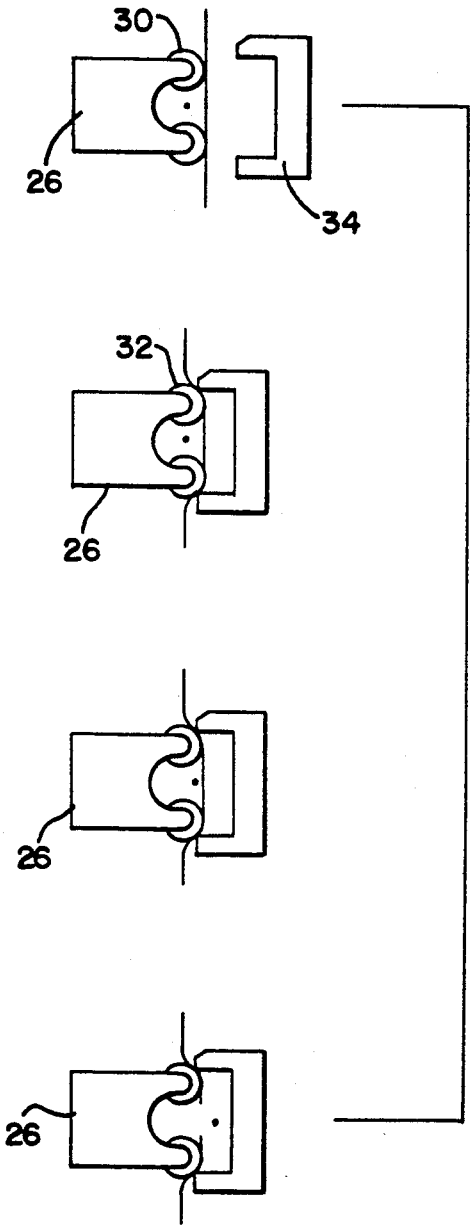
Figure 5:
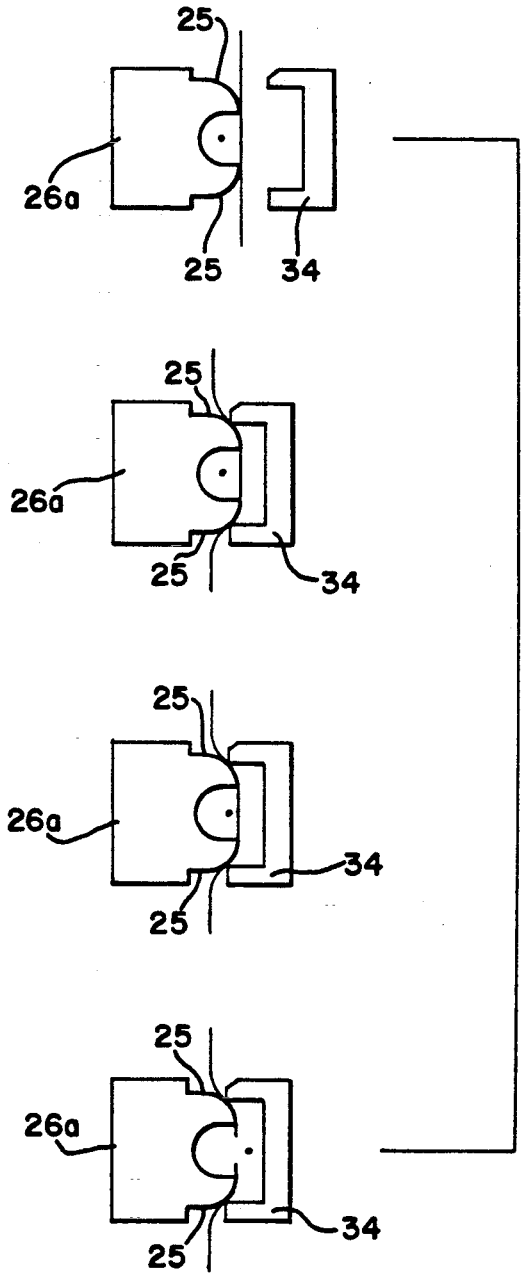

In FIGS. 4 and 5 two different types of cutting head are illustrated, the roller cutting head which has already been described and illustrated in FIG. 1 and a beak cutting head 26*a* shown in FIG. 5. The beak cutting head does not employ rollers such as 30 and 32 but simply has a shaped pair of jaws 25 which together form a beak against which the hot wire is held by the cutter bar 34 when the cutting action takes place.

In operation of both of these cutting heads the operator first sets the sheet length required on a potentiometer dial 15*a* and then presses a push button marked start 16*a*. The two motor driven rolls feed the film into a catch tray, not shown. When the selected length is reached the rolls stop.

The control circuit then applies current to the cutting wire. After a delay the cutter bar indexes forward tensioning the film over the tension head. As the film is tensioned the tension head is pushed back by the cutter bar bringing the film into contact with the hot wire thus cutting the film. The cutter bar then retracts to its rest position allowing the tension head to return. This action separates the cut sheet of film which drops into a catch tray. The dispenser is then ready for use again. These operations are illustrated in series in FIGS. 4*a, b, c* and *d* and in FIGS. 5*a, b, c*, and *d*.

An alternative method of cutting is shown in FIGS. 6*a, b, c* and *d*. Here the collagen film 18 is again pulled off the roll 10 by driven rollers 20 and 22 and the hot wire cutter similar to that shown in FIG. 1 is employed.

Below the hot wire cutter are located tension blocks 62 and 64. In this method of cutting collagen film the same principles are used as in the twin feed roll tension head. Prior to cutting the tension block 62, 64 grip the film 18 and tension is applied in a downward direction. The hot wire is then passed through the film, the tension block separate the film after cutting and the film is dispensed into the catch tray as the tension blocks separate and return to the start position. These operations are illustrated sequentially in FIGS. 6*a, b, c* and *d*.

Yet another arrangement in which there is no tension head or cutter bar employed merely using a hot wire is illustrated in FIGS. 7*a* and *b*. Once again a roll 10 has collagen film 18 which is pulled off the roll by driven feed rolls 20 and 22. The film is maintained in tension by driven tension rolls 25 and 27. This method of cutting collagen film is in principle the same as the roller cutting head and the beak cutting head again by tensioning the film prior to cutting with a hot wire. In this instance the film remains stationary after the feed measuring cycle and the hot wires pass through the film. The tension rolls then continue to turn and dispense the film into the catch tray.

We claim:

1. A dispenser for sheet material, the dispenser comprising (a) means for extracting a length of sheet material from a roll defining an axis, (b) an axially extending head including two elements spaced by a fixed distance, each element having a convex surface, the spaced elements defining a gap between the convex surfaces, the head being movable forwardly toward the axis and backwardly and being biased forwardly, (c) an axially extending bar including two portions spaced by a fixed distance, the bar being movable toward and away from the axis, from an initial position to a final position, through a range of intermediate positions wherein the spaced portions of the bar are disposed to draw an extracted length of sheet material over the convex surfaces of the spaced elements of the head and tautly across the gap and to clamp the tautly drawn material to the convex surfaces, (d) means for moving the bar from the initial position, through the intermediate positions, to the final position, the head being movable backwardly with the bar as the bar is moved through the range of intermediate positions to the final position, and (e) means including a stationary, electrically heated, axially extending wire for severing the length of sheet material from sheet material remaining on the roll, the heated wire being disposed between the spaced elements of the head before the head is moved backwardly with the bar, whereby, after the extracted length of sheet material is drawn tautly over the convex surfaces of the spaced elements of the head and is clamped to the convex surfaces, movement of the bar through the range of intermediate positions to the final position moves the head and the tautly drawn length backwardly with the bar so as to bring the tautly drawn length into contact with the heated wire.

2. The dispenser of claim 1 wherein the spaced elements of the head comprise rollers defining axes parallel to the axis defined by the roll of sheet material.

3. The dispenser of claim 1 wherein the spaced elements of the head comprise jaws and the convex surfaces of the spaced elements axially extend on said jaws.

* * * * *